US006247359B1

(12) United States Patent
De Angelis

(10) Patent No.: US 6,247,359 B1
(45) Date of Patent: Jun. 19, 2001

(54) APPARATUS FOR IDENTIFICATION OF NEED TO REPLACE SYNTHETIC FIBER ROPES

(75) Inventor: Claudio De Angelis, Lucerne (CH)

(73) Assignee: Inventro AG, Hergiswil NW (CH)

( * ) Notice: Subject to any disclaimer, the term of this patent is extended or adjusted under 35 U.S.C. 154(b) by 0 days.

(21) Appl. No.: 09/449,332

(22) Filed: Nov. 24, 1999

(30) Foreign Application Priority Data

Dec. 7, 1998 (EP) ..... 98811203

(51) Int. Cl.[7] ..... G01L 5/04
(52) U.S. Cl. ..... 73/158
(58) Field of Search ..... 73/762, 847, 862.49, 73/158

(56) References Cited

U.S. PATENT DOCUMENTS 5,015,859 * 5/1991 Uejio ..... 250/358.1
5,834,942 11/1998 De Angelis .
6,080,982 * 6/2000 Cohen ..... 250/227.11

FOREIGN PATENT DOCUMENTS 0 731 209 9/1996 (EP) .

* cited by examiner

*Primary Examiner*—Max Noori
(74) *Attorney, Agent, or Firm*—MacMillan, Sobanski & Todd

(57) ABSTRACT

To identify the need for replacement of stranded synthetic fiber ropes, preferably ropes of aramide fiber, a torsionally neutral rope construction of load-bearing fiber strands is obtained by having at least two layers of strands laid together in opposite directions so that the torsional forces in the layers of strands compensate each other. If the layers of the strands become weakened by unequal amounts due to wear or external influences, when the rope is under load and running operationally it begins to twist about its longitudinal axis. The twisting of the rope can be made visible by a colored mark or strip extending along the length of the rope to indicate twisting of the rope thereby providing visual identification of the need for replacement of the rope.

8 Claims, 1 Drawing Sheet

APPARATUS FOR IDENTIFICATION OF NEED TO REPLACE SYNTHETIC FIBER ROPES

BACKGROUND OF THE INVENTION

The present invention relates generally to an apparatus for identifying the need to replace ropes constructed of synthetic fibers, preferably of ropes of aromatic polyamide.

From the European patent document EP 0 731 209 A1 a device for identifying the need to replace a stranded fiber rope is known. The stranded rope consists of several layers of high-tensile synthetic fibers, the layers being laid over each other and surrounded by a firmly bonding rope sheath. To make identification of the maximum allowable internal rope wear possible, the extruded sheath of the rope has different colors arranged coaxially. The rope sheath indicates abrasive wear that occurs on driving, or driven, ropes as a result of the slipping that occurs on the traction sheave due to differences in force. Experimental values are used to correlate the abrasive wear of the sheath, by reference to the defined running surface of the ropes in the traction sheave, to the state of wear in the interior of the ropes. Accordingly, as soon as the underlying color is visible, this is taken to indicate that the interior of the rope is worn to the maximum allowable extent, and that the rope must be replaced within a specified remaining period of time.

With the device for identifying the need to replace synthetic fiber ropes described so far, the state of the rope can be easily assessed by means of a simple visual check of the rope sheath. However, the indication obtained in this indirect manner depends on experimental values; it does not allow a statement to be made concerning the precise internal condition of the rope. Rope wear due to, for example, such factors as premature material fatigue, short-term overloading, or external influences is not taken into consideration.

The problem underlying the present invention is that of proposing a device for identifying the need to replace ropes which reliably indicates the true state of wear.

SUMMARY OF THE INVENTION

As a solution to the problem, the present invention has been developed. In essence, the present invention consists of a rope construction with outwardly neutral torsion properties, between whose individual layers of strands a reactive torque ratio ensures that the rope takes up a position of unstable torsional equilibrium. The relationship between torques in the rope acting in opposition to each other is set in such a way that weakening of the layers of strands by abrasive wear or other influences disturbs the internal torsional equilibrium, so that when the worn rope is loaded during operation it twists about its longitudinal axis until it takes up a new position of equilibrium corresponding to the changed conditions of torque. Twisting of the rope is therefore an indication of wear in the interior of the rope, which has caused a change in the specific characteristics of the rope, such as loss of breaking strength. Correspondingly, the change in structure of the rope is detected by means of a suitable device, and taken as an indication of the need to replace the rope, with even simple distortion of the rope being an indicator of an unacceptable amount of rope wear.

This makes it possible to achieve the advantage that the load-bearing synthetic strands, which are present in any case, simply by being laid in the manner specified according to the invention, can indicate any type of wear of the rope very simply as a twisting of the rope as soon as the weakening of the load-bearing structure of the rope due to wear exceeds a certain definable amount. Twisting of the rope, and therefore the need to replace it, can be detected without costly additional devices. In particular, by applying a reference mark, it becomes possible to check the condition of the rope visually.

In a further development of the invention, between the adjacent concentric layers of strands which are laid in opposite directions there is an intersheath to reduce friction. This has the advantage that the choice of materials and the dimensions of the intersheath can be used to determine the radial distance of the layers of strands from each other, and thereby the torsional equilibrium. Furthermore, the fatigue strength of the intersheath can be used to obtain a desired service life of the rope. As soon as the intersheath becomes worn through by the longitudinal displacement of the outer layers of strands which occurs due to relative movement when bending, points of contact occur with the strands laid in the opposite direction. Due to the rubbing of the strands against each other, the constricting force under tension, and the pressure on the sheave which arises as the rope passes over it, the lateral stress ultimately causes strands to fracture. Due to the causal relationships described above, the rope twists and thereby indicates that the rope is in need of replacement.

In a preferred embodiment of the invention the outermost layer of strands of a multi-layered stranded rope is systematically wound round, and in the opposition direction to, a multi-layer parallel-laid rope core. This has the advantage that the layer of the rope core which is adjacent to and carries the outermost layer of strands is subject to the greatest lateral stress as a result of which the filaments or strands of this layer of strands display points of damage before any others. Only this selected layer of strands is weakened, whereas all other layers of strands remain undamaged and ensure that the remaining load-bearing capacity of the synthetic fiber rope is adequate.

In a preferred embodiment of the invention there is a mark running along the length of the external surface of the unworn rope which indicates twisting of the rope in that the marking winds helically around the longitudinal axis of the rope.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
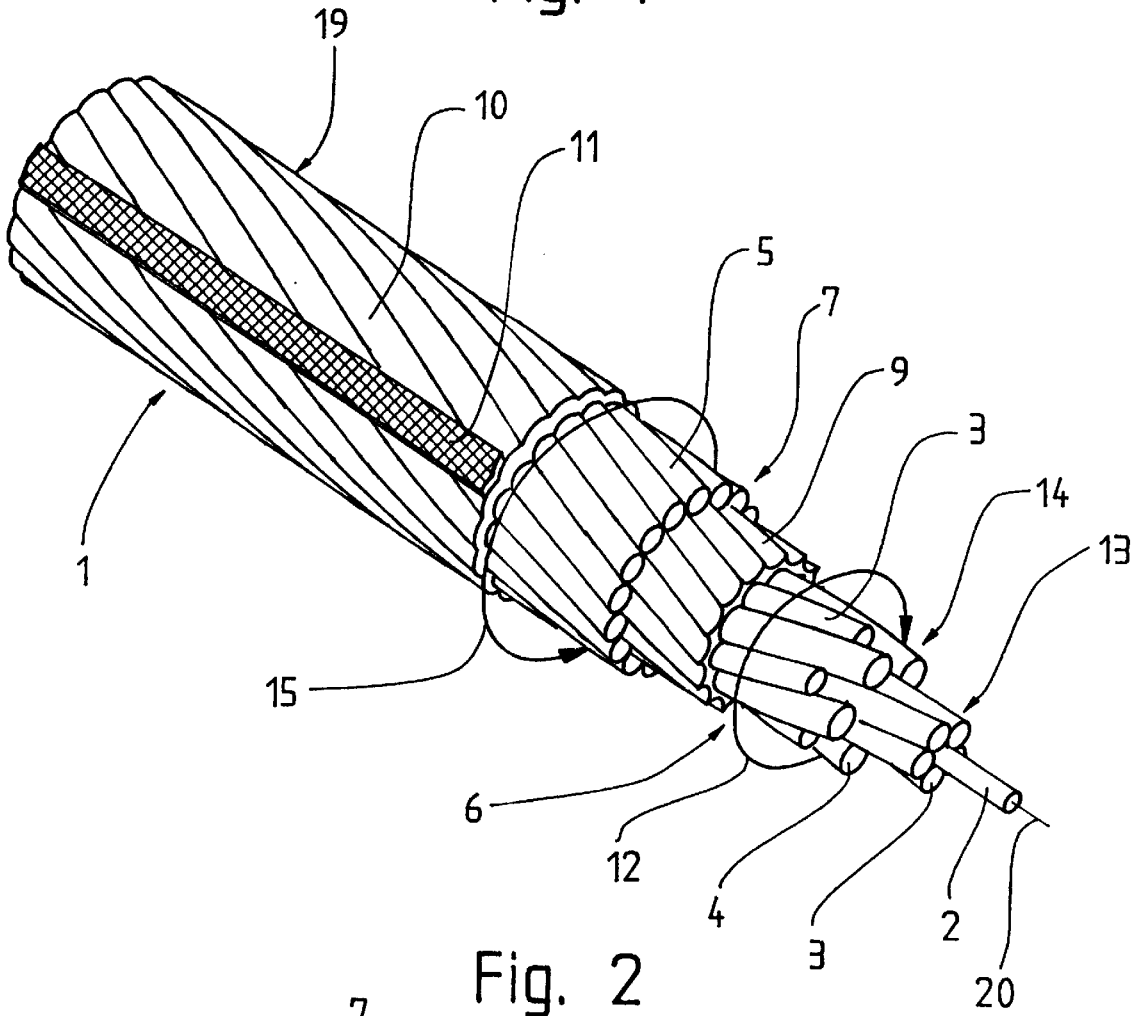
FIG. 1 is a perspective view of a first embodiment of the apparatus according to the invention for identifying the need to replace a rope.

FIG. 1 shows a sheathed aramide fiber rope 1 consisting of three concentric layers of high-tensile, load-bearing aramide fiber strands 2, 3, 4 and 5 laid on each other such as is used, for example, as a driving rope in elevator installations. In essence, the aramide fiber rope 1 is constructed with a parallel laid rope core 6 around which according to the invention a covering layer 7 of strands is laid in the opposite direction. Between the covering layer 7 and an adjacent layer of strands of the rope core 6 is an intersheath 9, preferably of polyurethane. A rope sheath 10 surrounds the exterior of the covering layer 7 and is positively bonded to it. Applied to the rope sheath 10 in the longitudinal direction along the entire length of the aramide fiber rope 1 is a wear resistant colored line 11 to indicate the rotational position of the aramide fiber rope. Instead of the colored line 11 other devices can be used which are suitable for indicating and/or determining the rotational position of the aramide fiber rope 1 relative to its longitudinal axis 20.

In the embodiment described here the covering layer 7, in combination with the layer of strands of the rope core 6 adjacent to the covering layer 7, the intersheath 9, and the colored line 11, together comprise the device according to the invention for identifying the need to replace the aramide fiber rope 1.

Figure 2:
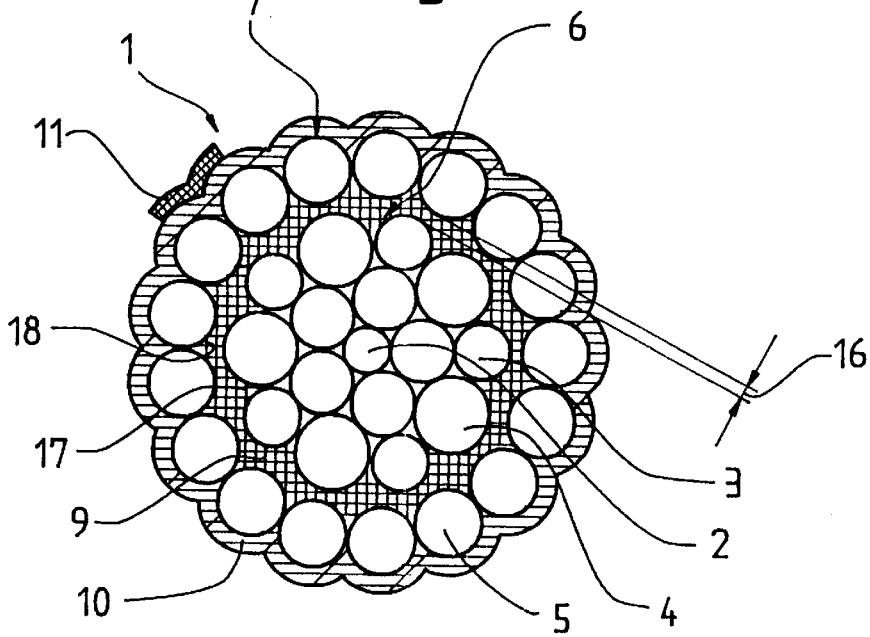
FIG. 2 is cross-sectional view of the apparatus shown in the FIG. 1.

The rope core 6 is constructed of a core strand 2, around which in a first direction of lay 12 five, for example, identical strands 3 of a first layer of strands 13 are laid helically, with which here a further ten strands 3 and 4 of a second layer of strands 14 is laid with parallel lay in a balanced ratio between the direction of twist and the direction of lay of the fibers and strands. The second layer of strands 14 comprises an alternating arrangement of two types of five identical strands 3 and 4. As the cross section in FIG. 2 illustrates, five further strands 4 with large diameter lie helically in the hollows of the first layer of strands 13 which supports them, while five strands 3 with the diameter of the strands 3 of the first layer of strands 13 lie on the highest points of the first layer of strands 13 that supports them and thereby fill the gaps between two adjacent strands 4 having a greater diameter. In this way the doubly parallel laid rope core 6 receives the second layer of strands 14 with an almost cylindrical external profile which in combination with the intersheath 9 affords further advantages which are described later.

When the rope 1 is loaded longitudinally the parallel lay of the rope core 6 creates a torque in the opposite direction to the first direction of lay 12.

Here the covering layer 7 also consists of seventeen aramide fiber strands 5, which are laid in a second, opposite direction 15 to the first direction of lay 12. When the rope 1 is loaded longitudinally it develops a torque in the opposite direction to that of the parallel laid rope core 6.

In a manner independent of their number and construction, the various layers of strands 13 and 14 of the rope core 6 and the covering layer 7 must be adapted to each other in such a way that their torques in opposite directions cancel each other out. When an aramide fiber rope 1 balanced in this way is under load and runs over a traction sheave it has no external torque. In embodiments going beyond that described above, there can be one or more coaxially laid layers of strands each laid in the opposite direction to the layer of strands supporting them. Furthermore, multiply laid covering layers of strands can be constructed. With reference to the advantageous effect derived from the invention, care must be taken that the ratio of torque between the layers of strands is not less than a specified value between 0.1 and 1.

As a possibility for balancing the internal torsional equilibrium the radial distance between the layers of strands is the determining factor. This distance is determined by the diameter of the strands used, the thickness of the intersheath which is described below, the number of layers of strands in the rope core, and the number of strands used in the covering layer. The latter can, for example, be laid together with non-load bearing strands to form the covering layer.

All the load-bearing strands 2, 3, 4 and 5 used for the aramide fiber rope 1 are twisted or laid from single aramide fibers and treated by impregnating with a substance such as, for example, polyurethane solution which protects the aramide fibers. High-tensile synthetic fibers such as, for example, aromatic polyamides or aramides with highly oriented molecule chains have a high load-bearing capacity and low specific weight. However, due to their atomic structure, they have a low ultimate elongation and are sensitive to stresses that occur laterally. It is precisely these material properties that are used according to the invention to provide a simple way of determining the state of wear of the interior of a rope made from high-tensile fibers by means of a visual indicator.

The intersheath 9 between the rope core 6 and the covering layer 7 consists of polyurethane or polyester. It is injection molded onto the rope core 6 and fills all interstices 17 and 18 between the strands 3, 4 and 5 of the two adjacent layers of strands 7 and 14. This creates a positive bond with a large area of contact that serves to transmit torque between the rope core 6 and the covering layer 7. The intersheath 9 prevents contact between the covering layer 7 and the second layer of strands 14, and thereby wear of the strands 3, 4 and 5 due to their rubbing against each other, and to the movement of the strands 2, 3, 4 and 5 relative to each other, as the rope 1 runs over a traction sheave not shown here. The thickness of the intersheath 9 has a dimension such that, with the maximum allowable load on the rope, the interstices 17 and 18 between the strands are completely filled under the constricting force created by the covering layer 7, and such as to ensure that there is a remaining sheath thickness 16 of 0.1 mm between strands 3, 4 and 5 of the adjacent layers of strands 14 and 7.

The rope sheath 10 made from polyurethane surrounds the covering layer 7 and provides the desired coefficient of friction on the traction sheave. The polyurethane is so resistant to wear that it does not become damaged as the rope 1 passes over the traction sheave. While passing over the traction sheave, the rope sheath 10 is extruded onto the covering layer 7 and the synthetic material, which is capable of flowing, is pressed into all the interstices 17 and 18 of the covering layer of strands 7 thereby creating a large area of contact. On the external surface 19 of the rope sheath 10 there is a colored line 11 running in the direction of the length of the rope 1 as a reference mark which indicates the rotational position of the rope 1. Instead of the colored line 11 other devices or markings can be provided, which enable rotation of the rope 1 to be detected in a suitable manner. The colored line 11, or a corresponding device, can also be applied directly to the covering layer 7 if there is no rope sheath 10.

The following manner of functioning of the device for identification of the need to replace synthetic fiber ropes as described so far relates to a driven elevator rope made from aramide fibers which connects a car frame of a car, which is guided in an elevator hoistway, to a counterweight. To raise and lower the car and the counterweight the rope runs over a traction sheave that is driven by a drive motor. The drive torque is transferred by friction to the section of rope that at any moment is lying in the angle of wrap. At this point the rope 1 is subjected to high transverse forces.

The driving rope 1 which according to the invention is neutral in relation to torque is laid onto the traction sheave without twist, i.e. without being twisted about its longitudinal axis 20 between the torsionally rigid fastening points on the car at the one end and on the counterweight at the other end. During installation of the rope 1 the mark, which here takes the form of the colored line 11 along the length of the rope 1, also serves as an installation aid for aligning the rotational position of the rope 1 relative to a reference point, for example the traction sheave. It is expedient for the rope 1 to be installed aligned in such a way that the course of the mark can be visually checked while the rope 1 is in motion.

When the loaded rope 1 reverses at the traction sheave, the strands 2, 3, 4 and 5 move relative to each other to compensate differences in tensile stresses. These relative movements are greater in the outer layers of strands 7 and 14 and become smaller toward the core strand 2. Due to the longitudinal displacement of the strands 5 of the covering layer 7 being able to cause wear, the intersheath 9 between the outermost and inner layers of strands, which otherwise prevents contact between the strands of the various layers, suffers abrasion and wear to the point of unserviceability. The point in time at which the intersheath 9 becomes unserviceably worn can be determined in its design by means of the torsional rigidity of the intersheath 9.

As soon as the intersheath 9 becomes unserviceably worn due to the longitudinal movement of the strands 5 of the covering layer 7, points of contact occur between the strands 3, 4 and 5 laid in the opposite direction. The strands 3, 4 and 5 of the layers of strands 7 and 14 rubbing against each other, the pressure, and the lateral stress due to the constrictive force of the outer layer of strands, namely the covering layer 7, lead ultimately to fractures in the strands 3 and 4 of the second layer of strands 14. This causes weakening of the second layer of strands 14 which then creates substantially less torque, or none at all, when the rope is loaded. This in turn causes the internal torsional equilibrium to be disturbed and the unserviceably worn rope 1, while moving in operation, to twist about its longitudinal axis 20 until it has taken up a new position of equilibrium corresponding to the changed conditions of torque.

Twisting of the rope 1 can be visually detected in that the colored line 11 or another corresponding mark along the length of the rope 1 winds helically around the longitudinal axis 20 of the rope 1. Even simple distortions of the rope are already a sign that the mechanism described above is active.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for identifying the need to replace a synthetic fiber rope constructed of at least two concentric layers of strands laid together and made from load-bearing aramide fiber strands, which rope has a service life dependent on the load on the rope, the two concentric layers of strands being adjacent and laid in opposite directions to each other, comprising: an indicating device visible on an exterior surface of the rope for detecting and visually indicating a rotational position of the rope about its longitudinal axis.

2. The apparatus according to claim 1 wherein the rope has an intersheath between the adjacent concentric layers of strands.

3. The apparatus according to claim 1 wherein the two concentric layers of strands include a covering layer laid on a parallel laid rope core in a direction opposite to that of said rope core.

4. The apparatus according to claim 1 wherein said indicating device is a colored strip attached to said exterior surface and extending parallel to a longitudinal axis of the rope.

5. The apparatus according to claim 1 wherein said indicating device is a colored line on said exterior surface and extending parallel to a longitudinal axis of the rope.

6. The apparatus according to claim 1 wherein said indicating device extends parallel to a longitudinal axis of the rope along an entire length of the rope.

7. An synthetic fiber rope comprising:

at least two concentric layers of strands laid together and made from load-bearing aramide fiber strands, said layers of strands being adjacent and laid in opposite directions to each other; and an indicating device visible on an exterior surface of the rope for detecting and visually indicating a rotational position of the rope about its longitudinal axis.

8. The apparatus according to claim 7 wherein said indicating device includes a colored line extending parallel to a longitudinal axis of the rope.

* * * * *